US005695038A

United States Patent [19]

Keith, III et al.

[11] Patent Number: 5,695,038

[45] Date of Patent: Dec. 9, 1997

[54] DROP SAFE

[75] Inventors: Jasper Newton Keith, III, Lilburn; William L. Gunn, Atlanta; William D. Heath, Jr., Breman, all of Ga.; John F. G. Angove, Medford, N.J.

[73] Assignee: Brink's, Incorporated, Darien, Conn.

[21] Appl. No.: 506,021

[22] Filed: Jul. 24, 1995

[51] Int. Cl.[6] ..... G07G 1/12

[52] U.S. Cl. ..... 194/206; 235/379; 902/13

[58] Field of Search ..... 194/206, 207, 194/217, 218; 232/7, 15, 16; 235/379; 902/13; 186/37

[56] References Cited

U.S. PATENT DOCUMENTS

| | | | |
|---|---|---|---|
| 4,070,564 | 1/1978 | Tucker . | |
| 4,310,885 | 1/1982 | Azcua . | |
| 4,436,182 | 3/1984 | Simonotti et al. | 186/37 |
| 4,877,235 | 10/1989 | Robinson . | |
| 4,977,502 | 12/1990 | Baker et al. | 232/7 X |
| 5,173,590 | 12/1992 | Nakano et al. | 235/379 |

*Primary Examiner*—F. J. Bartuska
*Attorney, Agent, or Firm*—Jones & Askew

[57] ABSTRACT

A drop safe for receiving and temporarily storing currency or other valuables from a cash register or point-of-sale terminal. The drop safe uses bill acceptors to transfer cash into sealed cassettes within the safe. An envelope drop assembly allows transferring into the safe currency or non-cash items not accepted by the acceptor. The drop safe door has a door control assembly including a gas spring to counterbalance the weight of the door for controlled movement during opening. The door is locked by a pair of door bolts linked to a lock cam, which is secured by a dead bolt against movement. An electronic control unlocks the dead bolt in response to entry of correct numbers, allowing a rotary dial of the outside of the safe to move the lock cam and release the door bolts. The drop safe includes a processor programmed to control the unlocking operation and to maintain and produce various reports of deposits into the safe, enabling easy correlation of those deposits with business-day operation of the drop safe.

7 Claims, 11 Drawing Sheets

DROP SAFE

FIELD OF THE INVENTION

This invention relates in general to apparatus for securing currency or other valuables, and relates in particular to drop safes intended for temporary secure storage of currency awaiting transfer to another location.

BACKGROUND OF THE INVENTION

Retail sales outlets such as convenience stores and gas stations often receive a significant volume of cash receipts and need to secure those receipts from robbery or theft on the premises. Many such outlets, particularly those anticipating a high volume of cash receipts throughout their times of operation, contract with an armored-car service to pick up the receipts from the premises. Those services typically transport a merchant's receipts to a central location where the currency is counted, and then deposits the currency in a bank account for the benefit of the merchant. By thus arranging for periodic cash pickups, the reduced amount of cash remaining at the retail facility may present a less-inviting target for robbers and reduces the amount of money at risk if a robbery does take place.

Although armored-car pickups or other periodic cash deposits will reduce the maximum amount of currency on the premises, many retail sales establishments still prefer to maintain a relatively secure location for storing currency while awaiting pickup or deposit. This need is particularly desirable for facilities such as convenience stores, gas stations, and other facilities having substantial receipts in cash or other negotiables, and remaining open around the clock with little or no staff apart from the cashiers on the premises. Those cashiers close out their cash registers or other point-of-sale terminals at the end of their shifts, and usually transfer the receipts to a secure location within the premises for subsequent pickup or deposit. However, cashiers often are encouraged or instructed to remove currency from their cash drawers from time to time during a shift, to reduce the amount of money at risk if a robbery occurs. This removed currency likewise is transferred to a relatively secure location on the premises, awaiting pickup. In most retail facilities, it is desired to segregate the cash receipts for which each cashier is responsible, so as to maintain personal accountability for the cash removed from their cash drawers.

The conventional safe, equipped either with a combination lock or a key lock, is one possible secure location for temporarily storing currency awaiting pickup from a retail facility or other location. The obvious disadvantage of the conventional safe in that environment, however, is that the cashier or other store personnel must know the combination or have a key that opens the safe, in order to make periodic transfers of currency into the safe. That requirement significantly diminishes the benefit of transferring currency from cash registers to the safe, because an armed robber may coerce the store personnel into opening the safe.

So-called drop safes have become known in the art, to overcome the security problems associated with using a conventional safe for temporary storage of currency. A drop safe typically has a slot into which the cashiers may insert an envelope containing currency removed from the cash drawers during or at the end of each shift. The combination or key required for opening the safe is not available to anyone on the premises; only the armored car personnel or the store manager can open the safe. An armed robber thus can, at most, steal only the currency in the cash drawers at the time. Moreover, cashiers must remember to transfer currency to the drop safe at certain times or upon checking cash-drawer receipts to see whether currency on hand exceeds some set amount. Although conventional drop safes thus are an improvement over the conventional safe for temporary secured storage of currency, such safes still require each cashier to place receipts in a separate envelope, preferably marked with the cashier's name, before placing the currency into the drop slot of the safe. The cashier or store manager also must keep a log showing the amounts deposited and the name of the person making each deposit. That procedure is time-consuming and thus may not be followed, especially by cashiers who must serve a steady volume of customers.

Accordingly, it is an object of the present invention to provide an improved drop safe for receiving currency or other valuables.

It is another object of the present invention to provide a drop safe that can automatically inspect currency presented for deposit, accept and count those bills that meet a predetermined minimum standard of quality, and reject those bills that fail to meet the quality standard.

It is a further object of the present invention to provide a drop safe that maintains a running tally of currency accepted for deposit into the safe.

It is still another object of the present invention to provide a drop safe that permits the manual deposit of rejected bills or other items not acceptable or readable by a currency acceptor mechanism.

It is another object of the present invention to provide a drop safe having a manual drop for envelopes or the like in addition to one or more currency acceptors for transferring currency into the safe.

It is still another object of the present invention to provide a drop safe having an improved locking mechanism.

It is yet a further object of the present invention to provide a drop safe having an improved mechanism for controlling the opening of a door to the safe.

It is still another object of the present invention to provide a drop safe that can identify and count currency placed in the safe by several persons or at different times.

It is a further object of the present invention to provide a drop safe in which currency placed into the safe becomes disposed in at least one separate removable container within the safe.

It is still another object of the present invention to provide an improved drop safe that interacts with a point-of-sale terminal.

Other objects and advantages of the present invention will become more readily apparent from the following description of the invention and the preferred embodiment thereof.

SUMMARY OF THE INVENTION

Stated in general terms, the present drop safe comprises a secure housing intended for mounting near a location of cash transactions, such as a point-of-sale (POS) terminal or a conventional cash register. At least one bill acceptor is built into the drop safe, preferably mounted on a lockable door for accessing the interior compartment within the safe. Each bill acceptor scans the currency or other selected bills presented for acceptance, and accepts all proffered bills except those that fail to meet a predetermined minimum level of acceptability. A microprocessor associated with the drop safe receives data signals from the drop safe concerning the denominations of accepted currency, so as too record the mounts deposited into the safe and to provide reports of those deposits over selected intervals.

Stated in somewhat greater detail, the drop safe of the present invention includes a microprocessor controlled to operate the bill acceptor or acceptors installed in the safe. A keypad or other data entry device is connected with the processor and allows persons such as cashiers or store managers to deposit currency in the safe, indicating their employee or other identifying number, their work shift, and other desired identifying information. Where an embodiment of the drop safe includes two or more bill acceptors, a predetermined first acceptor may be designated for accepting all deposits until the currency-receiving cassette of that acceptor becomes filled with a predetermined number of bills. When that number is reached, the processor automatically disables that first acceptor and enables another acceptor associated with the drop safe; lights or other signal devices on the exterior of the safe identify the particular acceptor presently enabled for use. The cassettes associated with each bill acceptor are periodically removed from the drop safe by an armored-car driver or other authorized service person, and replaced with empty cassettes.

The drop safe includes a novel lock mechanism that requires no key or combination dial to operate. A door providing access to the drop safe is held closed by one or more bolts that may be withdrawn by turning a dial set into the front of the door. A bolt lock within the safe normally blocks the locking mechanism, preventing the dial from withdrawing the door bolts. To actuate the bolt lock and permit opening the safe, at least one and preferably two predetermined sequences of numbers must be entered into a keypad or other input device associated with the safe. These numbers may include an identification number unique to the store or other location of the safe, a number that usually will not vary from day to day. After the store ID number is entered, the armored-car service or other messenger enters his or her personal identification number (PIN), which may change from one visit to the next, preferably in a manner as explained below. The messenger then enters the combination of the safe itself. When the proper identification numbers and safe combination are entered and recognized by the processor associated with the drop safe, the bolt locking mechanism is actuated to enable withdrawing the door bolts by manipulating the dial on the safe door.

The present drop safe preferably also includes a device for accepting currency or similar valuables separate from the bill acceptors. In the preferred embodiment, this device takes the form of a drop mechanism for receiving envelopes or packets containing bills such as wrinkled or torn currency rejected by the bill acceptors, money orders, checks, or travelers checks. This envelope drop mechanism, in a preferred embodiment of the drop safe, fits in an aperture provided for that purpose in the door of the safe.

Stated in more detail, the manual drop mechanism includes a slide manually movable outwardly within the slot, exposing a compartment having a floor on which to insert an envelope containing currency or other valuables. When the slide is returned inwardly of the slot, the floor moves to a vertical position, so that the envelope fails by gravity into the safe. This door returns to the horizontal position when the slide is again moved outwardly in the slot, to block direct access to the interior of the drop safe and thereby thwart attempts to fish the contents of the safe through the envelope drop assembly.

The door of the present drop safe is hinged at the bottom, allowing that door to pivot outwardly when the door bolts are withdrawn by the locking mechanism. A door control assembly counterbalances the weight of the door, permitting a gradual controlled opening when the locking mechanism withdraws the door bolts. This door control assembly eliminates the need for pull handles or the like on the outside of the door, which might otherwise be used in an unauthorized attempt to force open the door.

Other objects and advantages of the present invention will become more apparent from the following description of a preferred embodiment.

DETAILED DESCRIPTION OF PREFERRED EMBODIMENT

Figure 1:
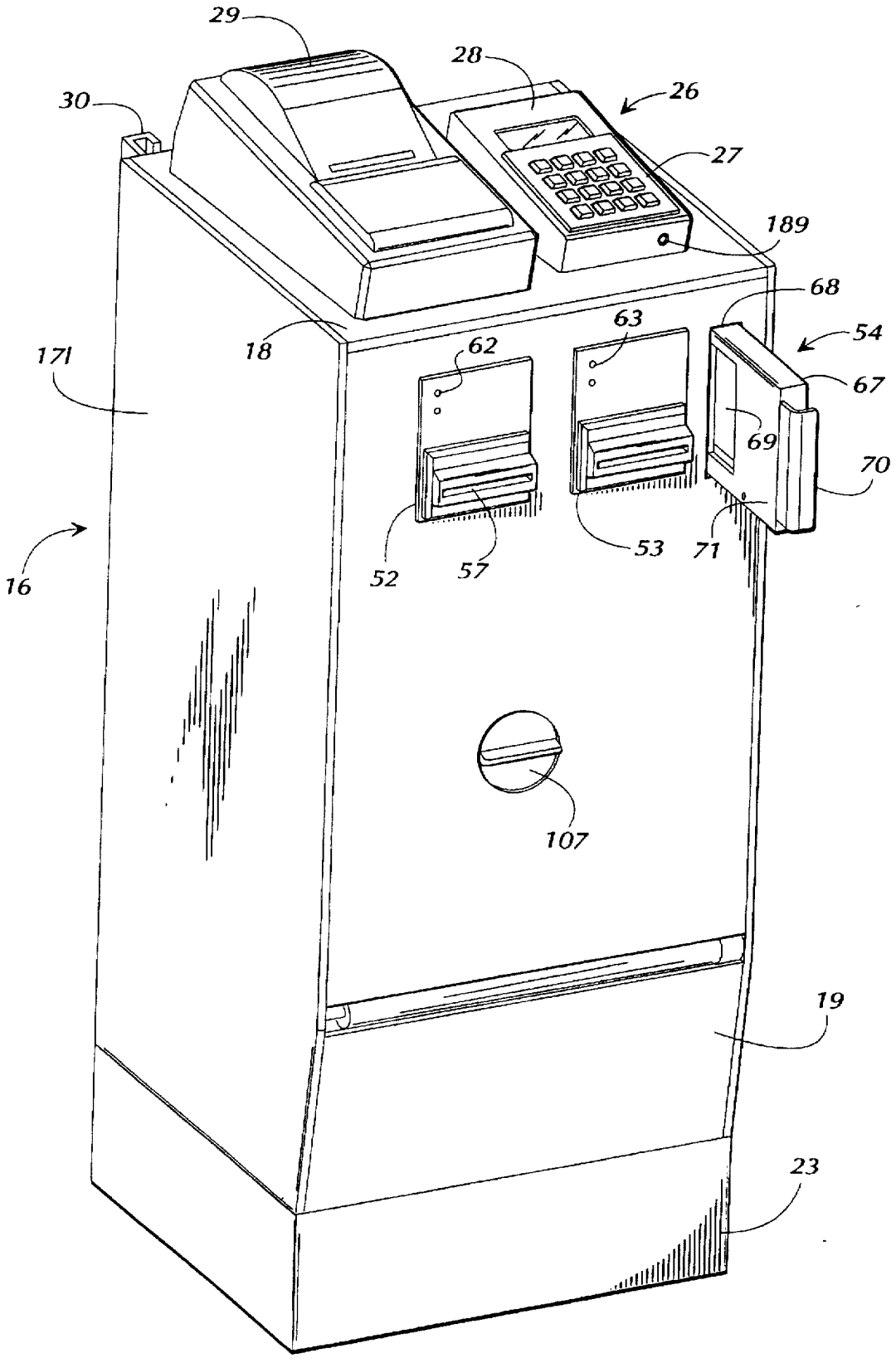
FIG. 1 is a pictorial view showing a drop safe according to a preferred embodiment Of the present invention.
Figure 2:
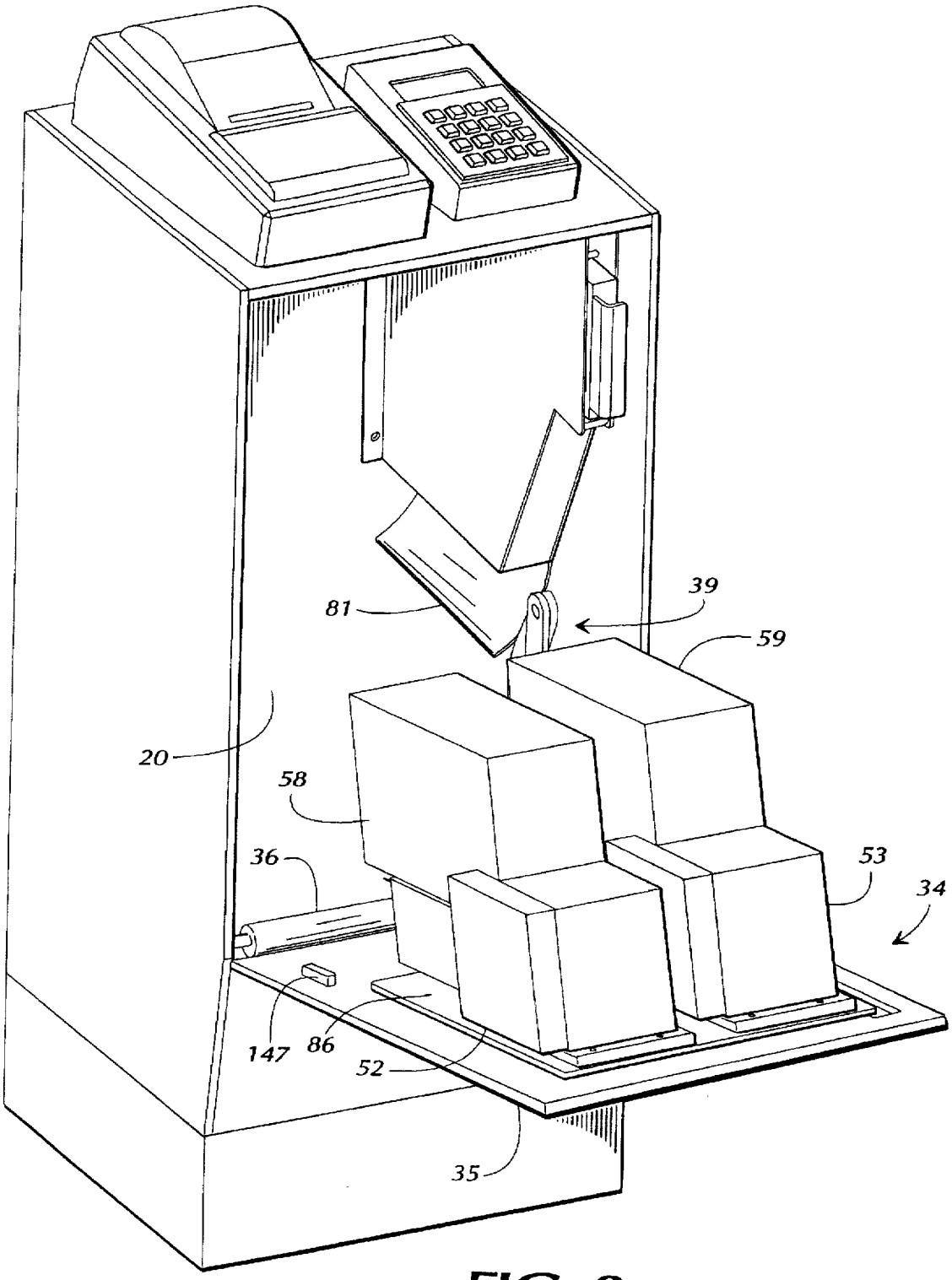
FIG. 2 is a pictorial view showing the embodiment of FIG. 1 with the door opened.

FIG. 1 shows at 16 a drop safe according to a preferred embodiment of the present invention. The drop safe 16 has an outer housing assembled from the side panels 171 and **17*r*, a top panel 18, and a back panel. The side panels, top panel, back panel, and a lower front panel 19 extending upwardly from the bottom of the drop safe, constitute a housing defining an interior space 20, FIG. 2, within the drop safe. The drop safe 16 is shown mounted on a separate base 23 to support the drop safe at a desired elevation above a floor or other surface on which the base rests. By selecting the height of the base 23, the overall height of the base and the drop safe 16 is adjustable to fit beneath a counter or some other space of limited elevation. The drop safe 16 preferably is connected to the base 23 with bolts or other suitable fasteners accessible only from within the interior space 20. Once the base 23 is securely anchored to the floor or other support structure, the drop safe 16** cannot be readily removed from the base unless the access codes are known for opening the door as described below.

The drop safe 16 of the disclosed embodiment includes a data input terminal 26 with a keypad 27 for entering information and a visual display 28 for displaying information to an operator. The drop safe also includes a printer 29 for printing reports or other information concerning operation and usage of the drop safe. The terminal 26 and printer 29 are connected to a processor 154 (FIG. 8), which is located within the interior space 20 of the drop safe for security reasons, by suitable wires leading to a connector panel 30 located on the back panel of the drop safe. The terminal 26 and printer 29 are here shown located on the top panel 18 of the drop safe, but it should be understood that those components may be placed on a separate countertop or elsewhere, for example, in installations where the drop safe is emplaced beneath a countertop or other structure limiting access to the top of the drop safe.

A door assembly 34 occupies the front of the drop safe above the lower front panel 19 and prevents unauthorized access to the interior space 20. The door assembly includes a door panel 35 fastened at its bottom to a hinge block 36 fitted at opposite ends with hinge shafts extending outwardly into the adjacent sides of the drop safe. This hinge allows the door assembly 34 to pivot between a closed position shown in FIG. 1 where the door panel 35 is substantially vertical, and the fully-open position shown in FIG. 2 where the door panel is almost horizontal to permit access within the interior space 20.

Figure 5:
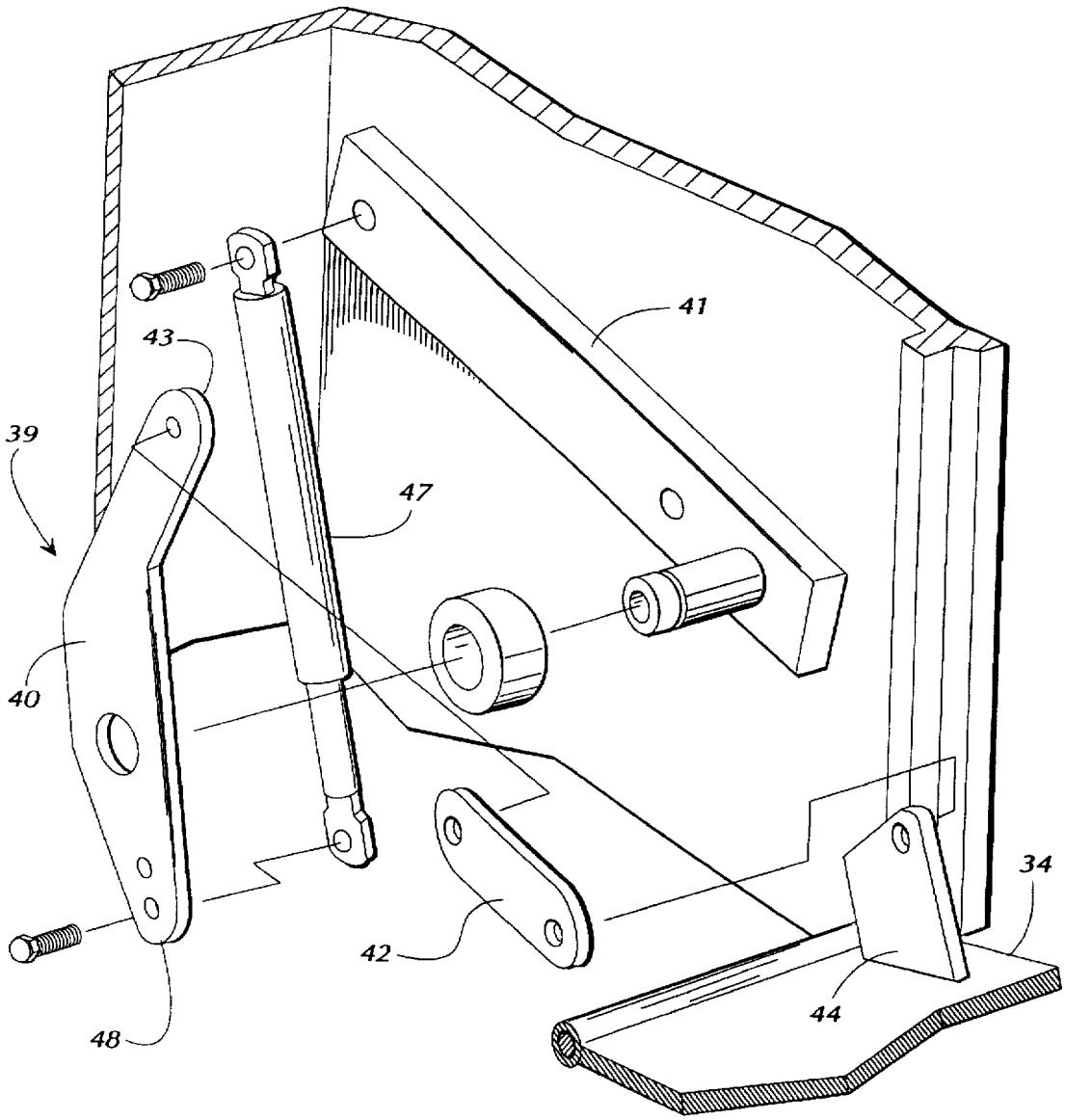
FIG. 5 is an enlarged exploded pictorial view showing details of the door control assembly in the preferred embodiment.
Figure 6:
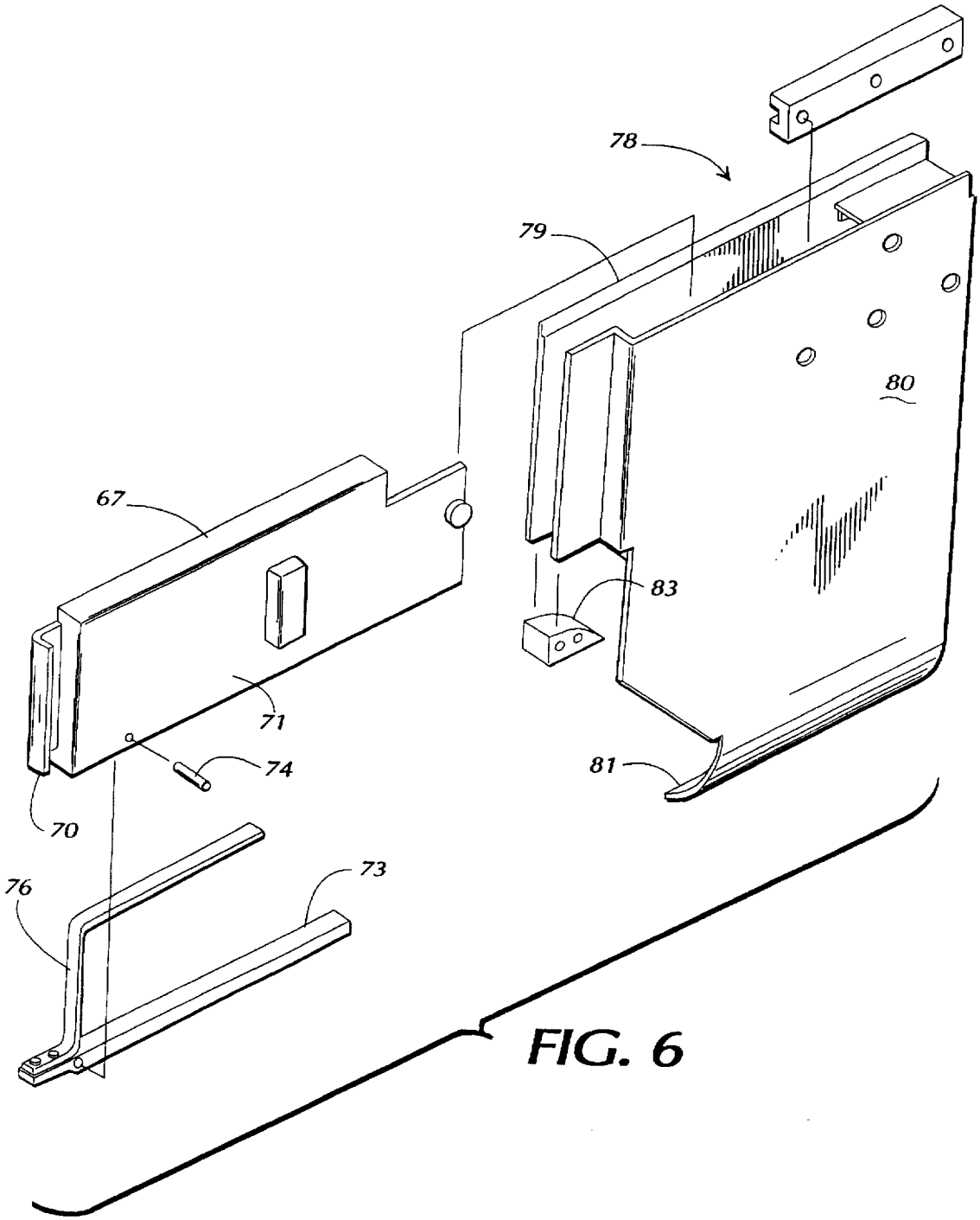
FIG. 6 is an enlarged exploded view showing details of the envelope drop assembly in the preferred embodiment.

A door control assembly 39, best shown in FIG. 5, permits opening and closing the door assembly 34 in a controlled manner. The door control assembly 39 includes a lever 40 pivotably mounted on a post 40*a* extending outwardly from a mounting plate 41 secured to the inside of the right side panel 17*r* of the drop safe. A link 42 is pivotably attached at one end 43 of the lever 40 remote from the pivot point of that lever. The link 42 extends to connect with an attachment plate 44 mounted on the inside of the door assembly 34. The piston rod of a gas spring 47 is pivotably attached to the other end 48 of the lever 40 remote from the pivot 40*a*. The body of the gas spring 47 is pivotably attached to the plate 41 at the end remote from the pivot attachment of the 40*a* lever 40. The control door assembly 39 as described may be preassembled and then attached to the inside of the right side panel 17 by bolts or other suitable fasteners extending through the mounting plate 41.

The door assembly 34 is normally locked in the closed position shown in FIG. 1. The center of mass of that door assembly in the closed position is slightly behind the pivot axis of the hinge block 36, so that the unassisted door assembly tends to remain shut upon opening the door lock as described below. The spring force exerted by the gas spring 47 through the lever 40 and the link 42 urges the door assembly open, allowing the door assembly to pivot outwardly in a gradual and controlled manner when the door is unlocked. As the opening door assembly pivots open to an intermediate position (not shown), for example, about 15° from the closed position, the geometry of the lever 40, the link 42 connected to the end 48 of that lever, and the gas spring 47 connected to the other end of the lever, allow the force of the gas spring to counterbalance the gravitational opening force acting on the door assembly. The door assembly thus becomes stabilized at the partly-open position. The person opening the door may then manually pivot the door down to the fully-open position shown in FIG. 2, where the counterbalancing force applied by the gas spring 47 through the lever 40 is insufficient to raise the door to the previous intermediate position. The door control assembly 39 thus permits a controlled opening of the door when the door lock is disengaged. Moreover, if the center of mass of the door assembly is slightly behind the hinge as aforementioned, the gas spring will initiate opening the door upon unlocking, thereby obviating the need for pull handles or other structure protruding from the front of the door, which might be used in an effort to force open the locked door.

A friction washer 45 fits around the post 40*a* and presses against a confronting side of the lever 40. The lever 40 preferably is connected to the post by a suitable device such as a frictionless thrust bearing (not shown) capable of pressing the lever against the friction washer 45 with a selectively variable amount of force. That frictional force thus regulates the amount of manual effort required to raise and lower the door assembly 34 from the intermediate position, and controls the amount of bounce in the movement of the door assembly.

Although a gas spring is used in the disclosed embodiment, it should be understood that other resilient elements such as a tension spring are alternatives. The gas spring, however, provides a controlled opening force and is preferred for that reason.

The door assembly 34 carries a pair of bill acceptors 52 and 53, and an envelope drop assembly 54, for inserting currency or similar bills into the interior space 20 within the drop safe. The currency acceptors used in an actual embodiment of the present invention are made by Mars Electronics International, of West Chester, Penn. Although the present embodiment utilizes two identical currency acceptors 52 and 53, it should be understood that drop safes according to the present invention could have a single such acceptor, or could accommodate more than two acceptors. As seen on the front of the door panel 35, each acceptor includes a slot 57 for presenting currency for acceptance, in the manner known to the art. The acceptor draws that bill into the slot 57 and examines characteristics of the bill to evaluate its authenticity. If the bill passes examination, the acceptor transfers that bill to a currency cassette 58 (or 59), FIG. 2, associated with that acceptor. However, if the bill undergoing examination fails to meet the criteria for acceptance, the acceptor partially ejects that bill from the slot 57 and may also emit an audible signal to alert the busy cashier that a bill was rejected. If an unacceptable bill is so worn that the acceptor cannot eject it, the acceptor will accept that bill to the cassette and produce a signal signifying an unrecognized bill. The sealed and locked currency cassettes are readily detachable from the acceptors when the drop safe is opened, allowing an armored-car messenger or other person to remove the cassettes and replace them with empty cassettes in minimum time.

Those skilled in the art will understand that currency acceptors are programmed, to use a predetermined algorithm or set of bill-scanning parameters for examining bills presented for acceptance. The nature of those parameters and the programming of bill acceptors are known to those skilled in the art and need not be repeated herein. Bills that are heavily wrinkled or soiled may be rejected by the acceptors, and those bills must be introduced through the drop slot mechanism.

For drop safes according to the present invention and having two or more acceptors, as in the preferred embodiment, each acceptor is associated with an indicator to indicate whether that acceptor is available for use. These indicators for each acceptor in the preferred embodiment are a pair of LEDs 62 and 63, respectively located above the bill slots for the acceptors 52 and 53. Each pair of LEDs includes a red LED and a green LED. Those LEDs, or alternative indicator devices as appropriate, are illuminated to tell the user which acceptor is presently enabled for use. The LEDs for the acceptors 52 and 53 are operated by the control processor forming part of the drop safe 16, as described below.

The envelope drop assembly 54 may be used to insert currency too wrinkled or damaged to pass through the acceptors, or to insert travelers checks or other bills not suited for the acceptors. The envelope drop assembly 54 includes an envelope slide 67 extending outwardly through a slot-like opening 68 in the door panel 35 to the right of the acceptor 53. A window 69 is formed in one side of the slide 67 for inserting an envelope or the like, to be transferred to the interior of the drop safe. A handle 70 is attached to the outermost end of the slide 67 for moving the slide into and out of the opening 68 in the door panel.

Figure 7:
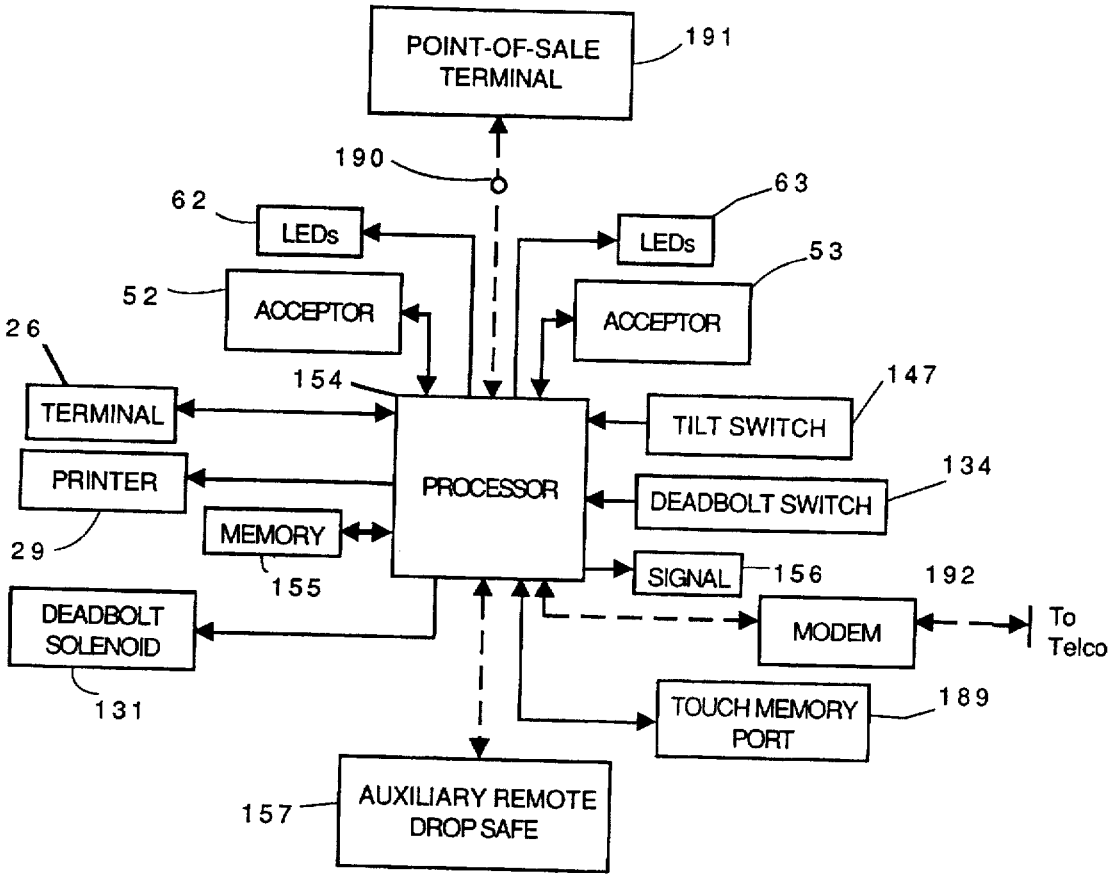
FIG. 7 is a block diagram of the control apparatus in the disclosed embodiment.

Envelopes or other articles placed in the slide 67 of the envelope drop assembly rest on a floor 73, as best seen in FIG. 7. That floor 73 extends along the bottom of the slide 67, between the parallel spaced-apart vertical walls 71 defining the slide. A pin 74 extends loosely through an opening at the forward end of the floor 73 and engages the sides 71 of the slide. The floor 73 thus is free to pivot in a vertical plane around the pin 74. An arm 76 attaches to the forward end of the floor 73, extending upwardly from the floor for a distance and thence extending rearwardly in substantially parallel relation to the floor. The vertical extent between the floor 73 and the parallel portion of the arm 76, within the slide 67, defines the space for receiving envelopes or other objects inserted through the window 69 of the slide.

The slide 67 extends through the opening 68 in the door panel 35, and is mounted for sliding movement in the housing 78 (FIG. 7) fastened to the inside of the right side panel **17*r* of the drop safe. The housing 78 comprises a pair of walls 79 and 80 spaced apart to accommodate sliding movement of the slide 67 between the panels. The lower end 81 of the wall 80 closer to the side panel 17*r* of the drop safe is crowed away from that side panel, to deflect toward the center of the interior space 20 the envelopes or other objects introduced through the envelope drop assembly 54**.

The slide 67 is mounted so that the floor 73 engages the surface of a cam 83 mounted between the walls 79 and 80 comprising the housing 78. The floor 73 rests on the upper surface of the cam 83 while the slide 67 is withdrawn from within the housing 78. However, when the slide 67 is fully inserted through the slot 68 and into the housing 78, the floor 73 is moved rearwardly to place the pivot pin 74, about which the floor pivots, behind the curved upper surface of the cam 83. The floor 73 thus pivots approximately 90° downwardly, effectively dumping into the housing 78 any envelope or the like previously inserted through the window 69 of the slide. When the slide 67 is again pulled outwardly from the housing 78, the cam 83 restores the floor 73 to its previous horizontal attitude. This arrangement effectively blocks any direct access through the slot 68 to the interior space 20 within the drop safe, because the floor 73 remains horizontal to block any such access through the window 69 while the slide is pulled even part way out from the door panel 35.

Figure 3:
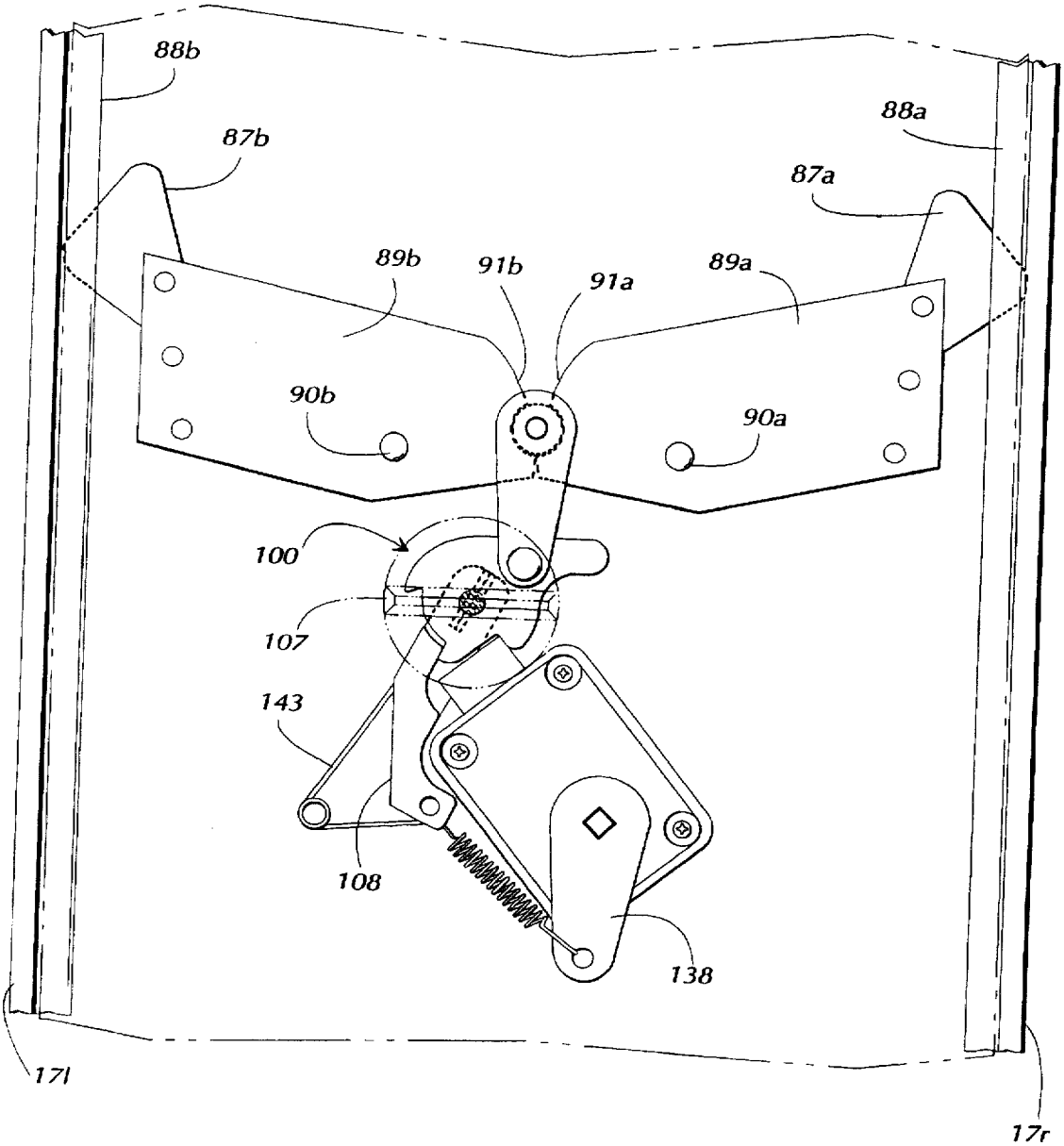
FIG. 3 is a front elevation view of the embodiment shown in FIG. 1, partially cut away to show details of the locking mechanism.
Figure 3A:
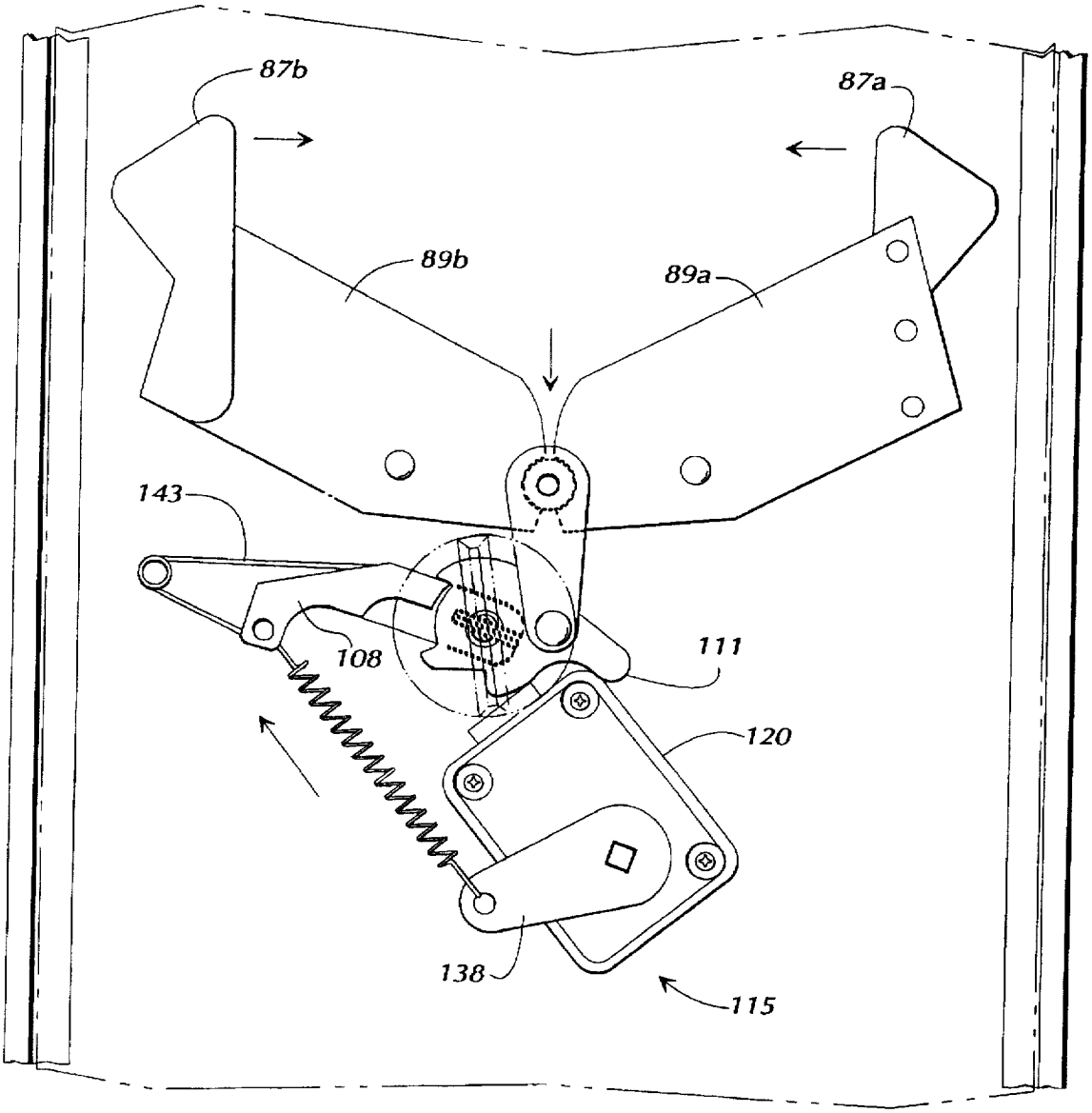
FIG. 3A is a view as in FIG. 3, showing the locking mechanism in the unlocked condition.
Figure 4:
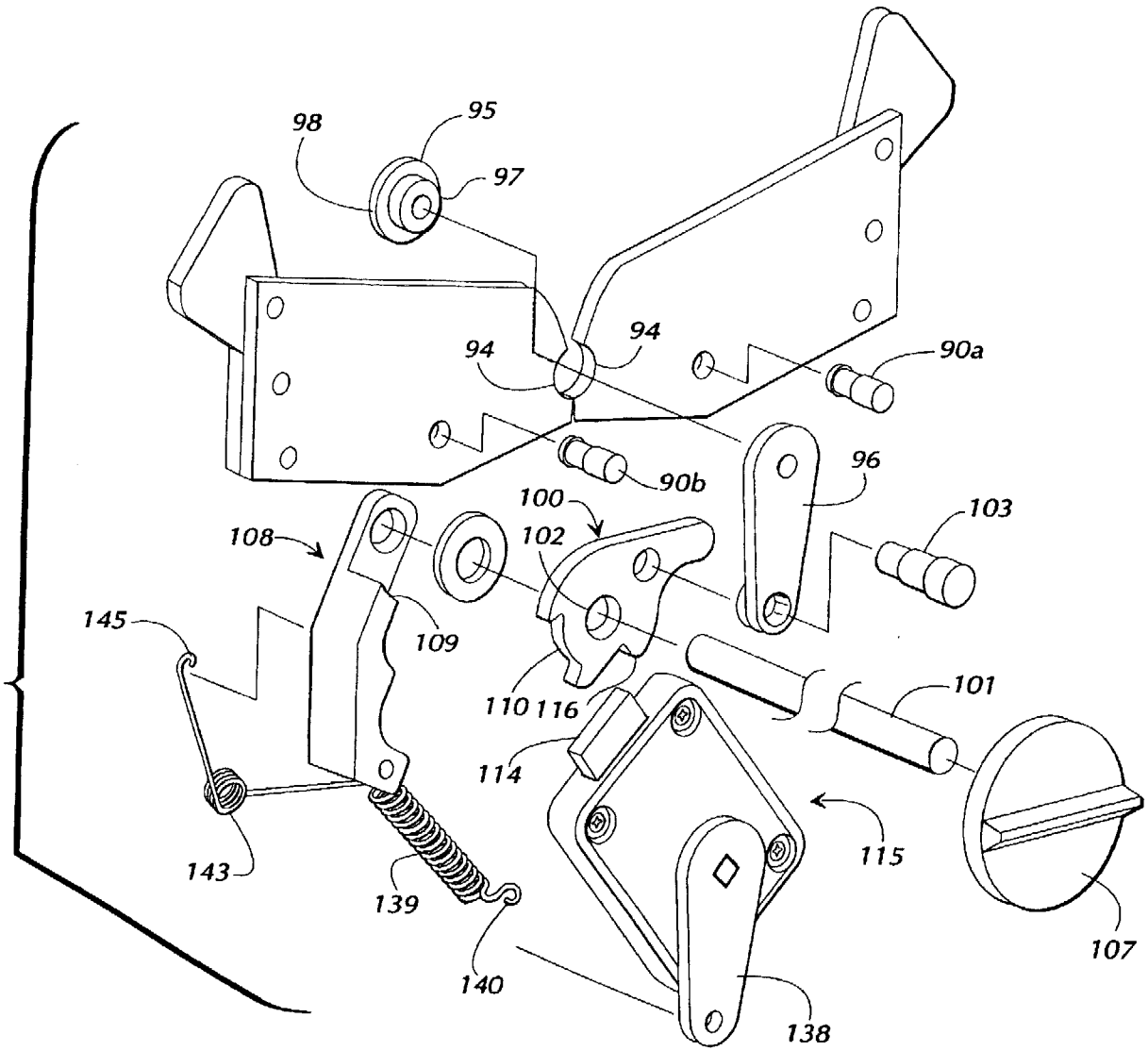
FIG. 4 is an exploded view showing details of the bolt locking mechanism in the disclosed embodiment.

The locking mechanism for the drop safe 16 is best seen in FIGS. 3, 3A, and 4. Looking first at FIG. 3, a pair of door bolts **87*a*, 87*b* are shown extending outwardly from the left and right edges of the door assembly to engage mating recesses in the bars 88*a*, 88*b* secured to the insides of the side panels 17*r*, 171 flanking the sides of the closed door. The door bolts 87*a*, 87*b* are attached at an outer end of the respective bolt plates 89*a*, 89*b* pivotably mounted on the back side of the door panel 35 by the pivot pins 90*a*, 90*b*. Each bolt plate extends inwardly beyond its pivot pin to an inner end 91*a*, 91*b*, with those inner ends confronting each other in close spaced-apart relation as best seen in FIG. 3. The bolt plates and other components of the locking mechanism are located on a lock plate 86 forming part of the door assembly 34 and mounted on the back side of the door panel 35**.

Each inner end **91*a*, 91*b* of the bolt plates contains a notch 94, best seen in FIG. 4. A bushing 95 is loosely retained within the confronting notches 94 of the bolt plates, and the bushing is held in place by securement with the upper end of a plate link 96 extending downwardly from the bushing. The bushing 95 has an inner collar 97 configured for a loose fit within the opposed confronting notches 94. A flange 98 of greater diameter than the collar extends radially outwardly from the collar and locates the bushing at one side of the confronting bolt plates 89*a*, 89*b*. The bushing 95 is located against the other sides of the bolt plates by the facing side of the plate link 96, which is secured against the confronting end of the collar 97. The diameters of the collar 97 and the mating notches 94 in the bolt plates are chosen to provide some lateral play of the bushing, so as to prevent binding as the bushing moves up and down while the bolt plates pivot on the pivot pins 90*a*, 90*b***.

The lower end of the plate link 96 overlies one side of a lock cam 100 supported for rotation relative to a dial shaft 101 extending through a central opening 102 in the lock cam. A pin 103 extends through an opening near the lower end of the plate link 96 and through an aligned opening 106 in the lock cam 100, radially displaced from the central opening 102. The plate link 96 thus moves up and down as the lock cam 100 is rotated about the dial shaft 101.

An outer end of the dial shaft 101 extends through the door panel 35 and is secured to the dial 107 on the front of the door panel. The dial shaft 101 passes through the central opening 102 in the lock cam 100 and is pinned to an opening in one end of a cam lever 108, FIG. 4, located behind the lock cam. The cam lever 108 thus is mounted behind the lock cam 100 and rotates with the dial shaft 101, on an axis concentric to that of the lock cam 100.

The cam lever 108 has an engagement portion 109 extending forwardly into the plane of the lock cam 100. That engagement portion occupies a circumferential cutout 110 on a peripheral part of the lock cam 100. The angular extent of the circumferential cutout 110 is greater than the corresponding extent of the engagement portion 109 located in that cutout, so that the cutout and engagement portion provide a lost-motion connection between the cam lever 108 rotated by the dial shaft 101, and the lock cam 100 driven by the cam lever. The extent of lost-motion in this connection is approximately 40° in the preferred embodiment, and its purpose is discussed below.

Referring again to FIG. 3, the door bolts **87*a*, 87*b* engage the bars 88*a*, 88*b* to lock the door assembly when the link plate 96 is raised, pivoting the bolt plates 89*a*, 89*b* around their respective pivot pins 90*a* and 90*b*. The lock cam 100, to which the plate link 96 is attached, is maintained in that locked position by the lock bolt 114 of a dead bolt mechanism 115 mounted on the lock plate 86. The lock bolt 14 is shown extended in FIG. 3, and in that position engages the shoulder 116 of the lock cam 100. The lock bolt 114 prevents the lock cam 100 from rotating when the cam lever 108 is rotated clockwise by turning the dial 107 to take up the slack in the lost-motion connection formed by the engagement portion 109 and the circumferential cutout 110 of the lock cam. The door assembly 34 thus remains locked while the lock bolt 114** of the dead bolt mechanism remains extended as shown in FIG. 3.

The dead bolt mechanism 115 used in the present embodiment of this invention is available from La Gard Inc. of Torrance, Calif. Details of this dead bolt mechanism are known by those skilled in the art, but it should be understood that other dead bolt mechanisms or locking devices may be substituted for the specific dead bolt mechanism disclosed herein. The lock bolt 114 slidably extends from one end of a housing 120 that also contains the bolt block 121. A spring within the housing 120 urges the lock bolt 114 outwardly from the housing 120 to the position shown in FIG. 3.

A lever 138 located along one side of the housing 120 connects to a shaft 128 operative to extend or withdraw the lock bolt 114. Within the housing 120 is a solenoid that locks the lock bolt 114 in its extended position when the solenoid is unpowered and unlocks the lock bolt when powered. A switch within the housing 120 detects the extended position of the lock bolt 114.

Returning now to FIGS. 3, 3A, and 4, a tension coil spring 139 is connected between the remote end of the lever 138 and an end 123 of the cam lever 108 remote from the dial shaft 101. The coil tension spring 139 attaches to the lever 138 by a spring loop 140 laterally offset from the coils of the spring.

One end of a torsion spring 143 also is connected to the remote end 123 of the cam lever 108. The torsion spring 143 is positioned on the side of the cam lever opposite to the lock cam 100, and the remote end 145 of the torsion spring is pivotably anchored at 144 to the lock plate 86. The torsion spring 143 provides a toggling action for the cam lever 108, as described below.

The locking mechanism operates in the following manner. With the door assembly 34 locked as shown in FIG. 3, the dial 107 can be rotated to a relatively limited extent but the lock bolt 114 keeps the lock cam 100 from rotating and thus maintains the door assembly locked. Opening is initiated by actuating the solenoid within the dead bolt mechanism 115, thereby freeing the lock bolt of the dead bolt mechanism. Control of that unlocking solenoid is discussed below. Once the lock bolt 114 is unlocked, an operator may then rotate the dial 107 clockwise, imparting the same rotation to the cam lever 108. The lock bolt 114 remains extended to block rotation of the lock cam 100 at this time, but the engagement portion 109 of the cam lever 108 travels through the lost-motion cutout 110 in the lock cam at this time. As the cam lever 108 rotates clockwise, its remote end 123 applies force to the remote end of the lever 138 through the coil spring 139. The lever 138 withdraws the lock bolt 114 from engagement with the shoulder 116 of the lock cam 100. The bolt block 114 becomes fully withdrawn from the shoulder 116 when the engagement portion 109 of the cam lever 108 reaches the end of the lost-motion connection within the cutout 110 of the lock cam.

Continued rotation of the dial 107 causes the cam lever 108 to rotate the lock cam 100 clockwise to the position shown in FIG. 3A, pulling the plate link 96 down and pivoting the bolt plates **89*a*, 89*b* to withdraw the door bolts 87*a*, 87*b* from engagement with the mating bars. The finger 111 extending outwardly from the lock cam 100 moves to abut the housing 120 of the dead bolt mechanism 115, as seen in FIG. 3A, when the lock cam is completely rotated clockwise to the unlocked position. This abutment, together with the yielding connection provided by the now-extended spring 139 between the cam lever 108 and the lever 138 connected to the dead bolt lock, protects the dead bolt lock from damage if anyone attempts to force the dial 107 beyond its full-unlocked position. Once the door bolts 87*a*, 87*b* are fully withdrawn, the door assembly 34 becomes unlocked and is free to pivot open under control of the door control assembly as described above. A tilt switch 147, FIG. 2**, is attached to the door assembly and provides an electrical signal indicating when the door pivots open from the closed position.

The torsion spring 143 acts on the cam lever 108 to resist rotation in the clockwise direction, when opening the drop safe from the locked position shown in FIG. 3. However, that torsion spring toggles to the position shown in FIG. 3A when the cam lever 108 is rotated fully-clockwise to the open position, thereby maintaining the locking mechanism unlocked while the door assembly is open. When the dial is rotated counterclockwise to relock the door mechanism as described below, the torsion spring 143 toggles back to the position shown in FIG. 3.

Closing and locking the drop safe is substantially the reverse of the opening procedure. After the door assembly is pivoted to the fully-closed position, the operator rotates the dial 107 counterclockwise, moving the plate link 96 upwardly and returning the door bolts **87*a*, 87*b* to the locked position. It is assumed the solenoid within the dead bolt mechanism 115 no longer is powered at this time, so that the lock bolt 114 will lock when returned to its extended position. The door bolts 87*a*, 87*b* preferably move outwardly to abut the bars 88*a*, 88*b* when the door is fully locked, providing a motion stop that limits the counterclockwise rotation of the lock cam 100 approximately to the position shown in FIG. 3 where the shoulder 116 is slightly past the path of travel for the lock bolt 114. Continued counterclockwise rotation of the dial 107 returns the cam lever 108 through the lost-motion connection to the initial position shown in FIG. 3, allowing the lock bolt 114 to its original position, engaging the shoulder 116 of the cam plate 100** and again locking the cam plate against clockwise rotation.

The present drop safe preferably operates under programmed control to limit access to the drop safe and thus to protect cashiers and other employees at locations using the drop safe. FIG. 7 schematically shows an embodiment of an operational control system for the drop safe. This system includes a programmable microprocessor 154 programmed to function as a central processing unit (CPU) for the system, and connected to a memory 155 for storing the microprocessor operating program for the drop safe as well as information relating to usage of the drop safe. The processor 154 accepts input signals from the acceptors 52 and 53, the dead bolt switch 154 located within the housing 120, the keypad 27 of the terminal 26, and the tilt switch 147; and sends operating signals to the LEDs 62 and 63 associated with the acceptors. The processor 154 also controls operation of the dead bolt solenoid 131 located within the housing 120, the printer 129, and the display 28 (FIG. 1) associated with the terminal 26. The processor also controls a signal device 156 for alerting a cashier or other operator of selected operating conditions. The signal 156 preferably provides an audible signal apparent to persons in the immediate vicinity of the drop safe, although that audible signal can be supplanted by a visual signal appearing on the display 28 of the terminal 26 or elsewhere. The processor 154 and the memory 155, together with the power supply and other related circuitry, are located on a circuit board suitably housed within the interior space 20 of the drop safe and linked by the connector strip 30 to a power source and external components such as the printer 29 and terminal 26.

In addition to the keypad 27 and the printer 29, a portable microchip memory module known to those skilled in the art preferably is used to extract data stored in the memory 155 relating to currency transfers into the drop safe, and to input information for unlocking the safe. For that purpose, the drop safe includes a memory module port 189 (FIG. 7) connected to the processor 154 and incorporated into the terminal 26 or otherwise accessible from outside the closed drop safe. The memory module port interfaces with a memory module chip (not shown) carried by the armored-car messenger, programmed to cause the processor 154 to transfer selected data corresponding to the contents of the drop safe at that time. When the messenger delivers the currency cassettes and envelopes to a counting facility at a central location, the memory module chip in turn is used to transfer that data to a computer equipped with a memory module port. This use of memory modules avoids rekeying the data from reports printed by the drop safe when the contents are being removed by the messenger. Memory module apparatus as described herein is available from Dallas Semiconductor Corp., Dallas, Tex., under the trademark "Touch Memory".

Operation of the preferred embodiment is now discussed with reference to the operating menus hierarchy shown in FIG. 8. It will be understood that manual entry of data or other information is accomplished using the keypad 27 of the terminal 26. The memory 155 associated with the processor 154 will accumulate and retain certain kinds of information, such as the dates and times of currency transfers into the drop safe, the number and dollar value of each transfer, and the cumulative total of bills and their dollar value accepted into the drop safe. It should also be understood that other kinds of information, such as separate PINs identifying a particular store or other site where the drop safe is located and the store supervisor or other person authorized to access certain kinds of information stored in memory, or to unlock the safe, also are retained in the memory. The operation and programming of microprocessors to perform the described operations are well known in the art and need not be explained herein.

Figure 8:
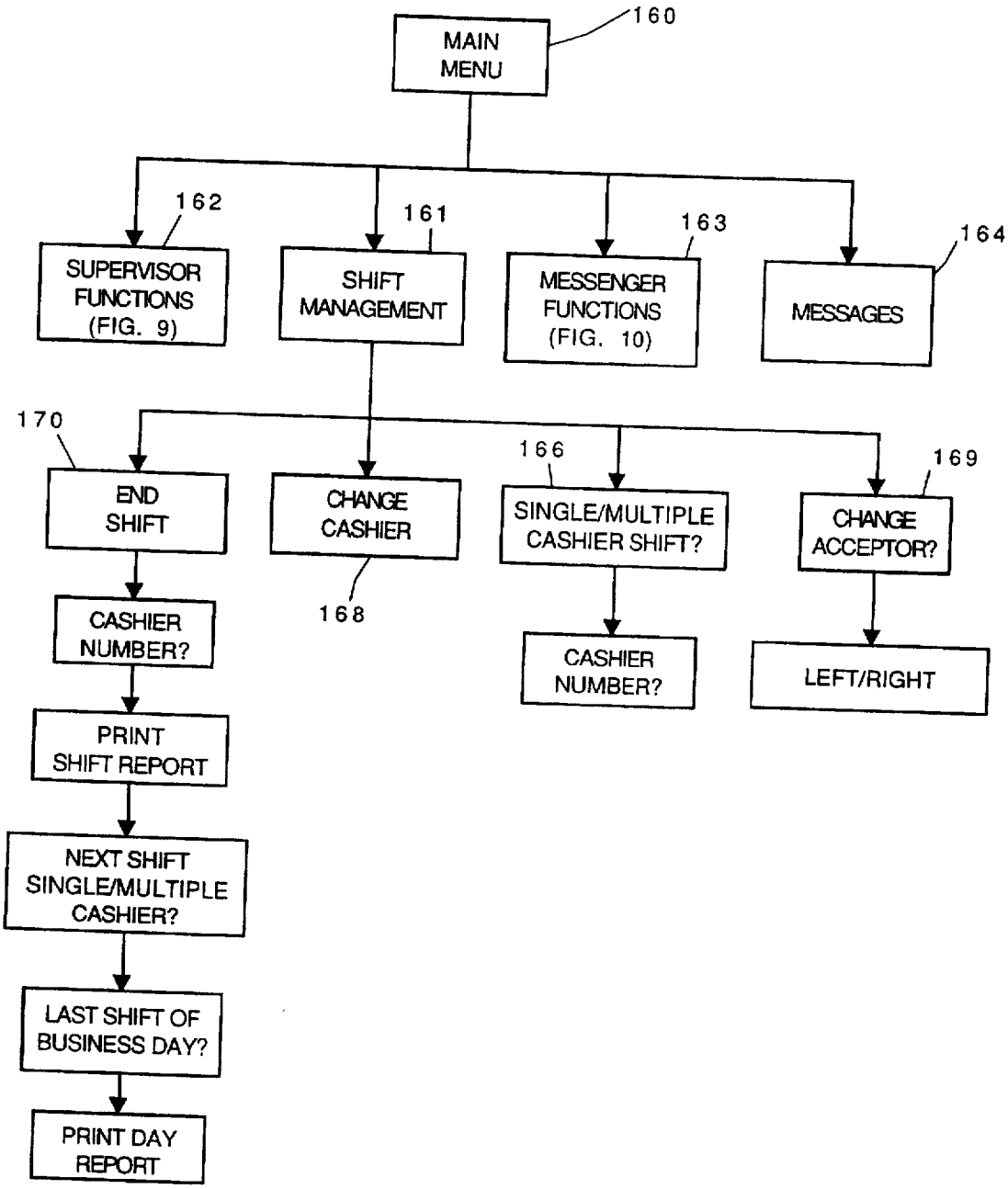
FIG. 8 is a block diagram illustrating a hierarchy of menus and related functions for operating the disclosed embodiment.
Figure 9:
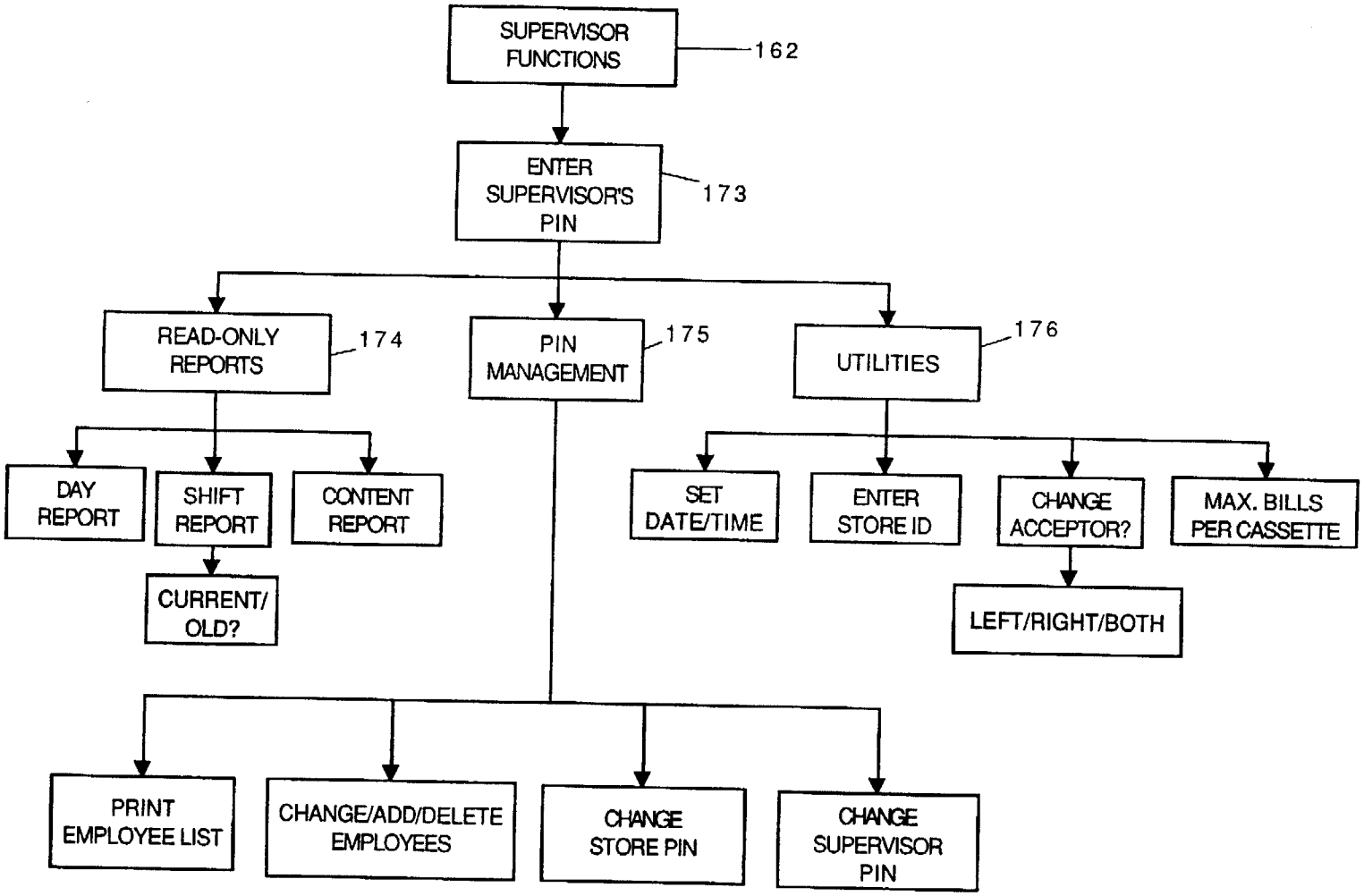
FIG. 9 is a block diagram illustrating the hierarchy of menus and related subfunctions for the supervisor functions shown in FIG. 8.

Referring now to FIG. 8, several menus are shown which appear on the display 28 when selected on the keypad 27 by a cashier or supervisor as indicated at 160 on FIG. 8. In response to selecting the main menu, the processor 154 prompts the operator to select any one of the four secondary menu functions shown in FIG. 8. These functions are shift management 161, supervisor functions 162, collection (messenger) functions 163 used for authorized opening and removing the contents of the drop safe, and message displays indicated generally at 164. Details of supervisor functions and collection functions appear in FIGS. 9 and 10, and are explained below with reference to those figures.

It is important that each deposit into a drop safe, whether by transfer through the acceptors of the present safe or by an envelope drop, be credited to the particular cashier who made that deposit. Furthermore, the amount of each deposit, together with the date and time of making the deposit, also is important not only for overall accountability but also to enable reconciling the deposits to a drop safe with each "business day" those deposits were made. Many stores operate on a business day that does not coincide with a standard calendar day. Instead, each business day for the store ends at a predetermined time such as 6:00 a.m. However, the contents of the drop safe usually are not removed coincident with the close of the business day. Moreover, an armored-car messenger may service a particular drop safe less often than each business day or calendar day, so that the deposits removed from a particular drop safe may include at least one business day and portions of two or more other business days.

By selecting the cashier menu 166, FIG. 8, the display 28 indicates whether single or multiple cashiers were last selected for the drop safe and gives the operator the option of continuing or changing that selection. That selection normally takes place at the beginning of each work shift in a particular business day. After the operator selects either a single-cashier or multi-cashier shift at the menu 166, the display prompts the operator to enter a cashier number previously selected and entered into memory for the particular cashier, or cashiers if a multiple-cashier shift has been selected. As each cashier number is entered into the keypad 27, the processor compares that number with information previously loaded into memory to confirm that the numbers match. The processor will return an appropriate error message to the display if an entered cashier number is not verified in that manner.

A submenu 168 under the shift management window 161 permits changing a cashier for the drop safe during an ongoing shift. That option would be used, for example, when a cashier previously selected for the drop safe at the start of a shift became sick or was otherwise unavailable to complete the shift, so that another cashier must be selected to deposit receipts into the drop safe during the remainder of that shift.

The change-acceptor function 169 is another option under the shift management function. This acceptor function allows a cashier to select either the left acceptor 52 or the right acceptor 53 as the primary acceptor for receiving bills. Although a default acceptor normally is available under the supervisor functions as discussed below, the change-acceptors function 169 allows a cashier to switch acceptors when the preselected acceptor becomes full or otherwise fails during a shift.

Each acceptor 52 and 53 sends the processor a signal indicating each acceptance of a bill, as well as the denomination of each accepted bill. The processor maintains in memory running total counts for the number of bills introduced to each currency cassette 58 and 59 attached to the acceptors. The processor also is programmed to compare the running total number of bills in each currency cassette with a preselected maximum number of bills for that cassette; those preselected numbers are variable under the supervisor function 162 of the program, as described below in greater detail. Once the processor determines that the running total of bills for a particular cassette 58 or 59 equals the preselected maximum for that cassette, the processor automatically enables the other acceptor and signals that change by changing the status of the LEDs 62 and 63 associated with the acceptors on the front of the drop safe.

The present drop safe is programmed to end a particular shift when the operator selects and confirms that function 170. The program then prompts the operator to enter the number of the cashier ending the shift. When that number is entered, the programmed processor automatically prints a shift report summarizing information for that shift as described below.

Because the end of one shift coincides with the beginning of the next shift, the end-shift function 170 immediately prompts the operator by asking whether the next shift is a multiple- or single-cashier shift. When the operator responds by entering the kind of shift, the program prompts the operator to enter the appropriate cashier number for that shift.

The end-shift function continues by asking whether the shift just concluded is the last shift of the business day. If the operator enters an affirmative answer to that prompt, the processor prints a day report giving particulars of drop-safe operation for that entire business day. The drop safe now is ready to commence operation in the new shift or day.

Each shift report and day report presents deposit activity for the drop safe during the most recent corresponding period of operation. The information in those reports can be summary or in detail, as desired by the store or other location of the safe. In a preferred embodiment, the shift reports are summaries of the drop safe activity during that shift, listing by cashier the total amounts of cash transferred to the cassettes, and the totals of cash and non-cash envelope drops during that shift. The shift report also lists the total number of envelopes deposited, and the total number of bills accepted but not recognized by an acceptor during that shift. Each shift report also may print the ratio of manual-drop cash to the cash deposited in the acceptors during the shift. Store operators may use this ratio for management purposes, for example, producing an alert signal when the ratio of manual-drop cash to acceptor-deposited cash exceeds a predetermined number.

Each printed shift report also includes a header identifying the particular store, the date and time of printing the report, a serial number of the shift report, and the name of the cashier or other person who printed the report. The date and time of the first and last deposit event during that shift also preferably appears on the shift report. If the shift report is printed during a current shift in response to a supervisor function 162 as described below, the shift report also would state that the totals thereon are incomplete.

A complete day report is printed, as mentioned above, at the end of the last shift of a business day. A typical day report for the present drop safe is an expanded version of the shift reports, summarizing by cashier, for each shift during that business day, the deposit information as discussed above for a shift report. After the detailed summary for each cashier during a shift, the day report summarizes the totals for each shift. Similarly, a summary of day totals is printed at the end of the shift totals for the last shift in that business day. The day totals thus summarize the total deposits into the drop safe, and the calculated ratios, during that complete business day.

The drop safe 16 preferably has a backup battery (not shown) to permit operation of the processor for a reasonable time and to open the drop safe during power outages. This backup power source allows cashiers to enter information concerning envelope drops dining a power outage, when AC line power is unavailable to operate the acceptors 52 and 53. It will be understood that the processor may have a separate battery sufficient to maintain information in the memory 155 for extended times, in accordance with accepted practice.

Once the operation of a particular shift is established for the drop safe, cashiers for that shift can transfer currency into the drop safe either through the acceptors or the envelope drop. If only a single cashier was previously entered as authorized for the shift, that person's name remains on the display 28 for the remainder of that shift so that the cashier need not enter his or her cashier number for each transfer into the drop safe. In that case, the cashier may simply present bills to an acceptor any time throughout the shift. If multiple cashiers were selected, the individual cashier making a deposit must enter the cashier number in the keypad 27 before the acceptors will accept a transfer. The processor is programmed to time-out the cashier at a predetermined time (for example, ten seconds) after the cashier number is entered or the last bill is presented to the acceptors, so that a later deposit by a different cashier on that shift will not be mistakenly credited to the cashier making an earlier deposit into the drop safe.

The drop safe may be operated so that only a selected one of the acceptors 52 and 53 can receive currency until the cassette 58 or 59 associated with that acceptor contains a predetermined number of bills. The activity status of each acceptor is indicated to the cashier by the state of the LEDs 62 and 63 located on the front of the door panel 35, associated with each acceptor. For example, if the acceptor 52 is designated to receive currency until the cassette 58 of that acceptor is filled, the green LED of the LEDs 62 for that acceptor is illuminated and the red LED of the LEDs 63 associated with the other acceptor also is illuminated. The cashier thus knows to tender all bills for acceptance to the acceptor 52 at this time. A running count of the number of bills accepted and stored in the cassette 58 (separate from a running total of the face amount of money represented by those bills) is maintained, either in the acceptor 52 or in the memory 155 associated with the processor 154. When the count of bills accepted for the currency cassette 58 reaches a predetermined number corresponding to maximum capacity for that cassette, the processor disables that acceptor and enables the other acceptor; the illumination status of the LEDs 62 and 63 is also reversed, informing the cashiers to make subsequent transfers into the other acceptor 53. If the currency cassette 59 associated with that other acceptor also becomes filled, then the red LEDs for both acceptors are illuminated and further currency drops must be made by envelopes through the envelope drop assembly 54, until the full currency cassettes are replaced with empty cassettes by an armored-car messenger or other authorized person.

The cashier then inserts the first bill in the appropriate acceptor. If that bill meets the criteria for acceptance previously set in the acceptor, the acceptor transfers that bill to the cassette associated with that acceptor. However, if the bill fails to meet those criteria, the acceptor ejects the bill and beeps to alert the cashier. If only a single cashier is authorized for a particular shift, the system can keep the currency acceptors active for immediate insertion of bills during that shift. If multiple cashiers were selected for the shift, the processor preferably is programmed to allow a preset time, such as ten seconds, to elapse after acceptance or rejection of a previous bill, during a multiple-cashier shift, during which the cashier can insert another bill. If the cashier exceeds that preset time, the cashier number must be reentered into the keypad before the drop safe will consider additional bills for acceptance. Another cashier authorized for that shift may enter his number to make a deposit at any time.

The currency acceptors used with the present embodiment are programmed to accept bills in denominations of $1, $2, $5, $10, $20, $50, and $100 and provide output signals indicating the denomination of each bill accepted. Those signals are received by the processor 154 and stored in memory, along with the count of accepted bills, so as to maintain a running cumulative total of the number and value of bills accepted throughout the shift and contained in each currency cassette.

If the cashier wants to deposit into the drop safe bills of another denomination, bills that were too wrinkled or disfigured for acceptance, or to deposit non-cash items such as travelers checks, she can press an "Envelope" key provided for that purpose on the keypad 27. The display 28 prompts entry of the cashier number. The display then prompts entry of the cash and non-cash amounts for that drop, and displays the entries for acceptance or revision by the cashier. Once those entries are completed, the printer 29 prints a ticket summarizing the entered data and including the date, time, and store identification of the drop safe. The cashier may then wrap that ticket around the items and secure the resulting packet with a rubber band, place the packet in the window 69 of the slide 67 associated with the envelope drop assembly, and then move that slide inwardly as described above so that the packet drops from the slide into the interior of the drop safe.

Returning to FIG. 9, the supervisor functions 162 for a typical drop safe according to the disclosed embodiment are detailed. When the supervisor functions are selected from the main menu, the display 28 requests entry of a supervisor's PIN as shown at 173. Once a PIN is entered and verified by reference to an authorized PIN previously stored in the memory 155, the drop safe displays secondary menu functions including a read-only report function 174, a PIN management function 275, and a utilities function 176. If the read-only reports function is selected, the operator is presented with the choices of printing a day report, a shift report, or a content report for the drop safe. Details of day reports and shift reports are discussed above. If the supervisor selects a shift report for printing, the display asks whether the report is for the current shift or for an old shift. If the operator selects an old shift, the system then prompts entry of the number for the shift. This number is determined in reverse serial order from the number of the current shift. Thus, if the current shift is shift number 3 as determined by data stored in the processor, the immediate-past shift was shift number 2 and entering that shift number causes the processor to print a shift report for that shift. The words "Report Reprint" will appear on this printed shift report, indicating that the shift report is not the original report that was printed at the close of the old shift, as discussed above. However, this reprinted shift report also will contain the words "Totals Complete" or equivalent, indicating that the totals on the reprinted report cover the entire time of that shift.

Selecting the PIN management function 175 allows the supervisor to change, add to, or delete the identification numbers of employees authorized for a store or other location containing the particular drop site. The supervisor also has the option of changing the PIN previously entered for the particular store (and used for opening the safe), changing the supervisor PIN, or printing a list of employees and their identification numbers currently authorized to use the particular drop safe.

The utilities function 176 allows setting various parameters not elsewhere considered. These include the option of setting the date and time maintained in the internal clock of the processor and printed on the various reports, and entering the identification number of the particular store where the drop site is located. This store identification, which should not be confused with the store PIN mentioned previously, will appear on each report printed by the drop safe and correlates those reports with the particular store.

The utilities function 176 also allows the supervisor to change the default acceptor, or to select both acceptors for entry of bills. Another acceptor-related utility function allows setting the maximum number of bills per cassette for each acceptor. The ability to set that function is important because the acceptors currently in use can accommodate cassettes of different bill-holding capacities. By entering the maximum number of bills for each cassette, the processor automatically switches to the second acceptor when the first acceptor has received the previously-set maximum number of bills. If both acceptors have received their maximum bill capacities, the processor disables both acceptors and signals that event by turning the red LEDs 62 and 63 associated with the acceptors. Cashiers must then make further deposits through the envelope drop, until the armored-car messenger has replaced the full cassettes with empty ones.

Figure 10:
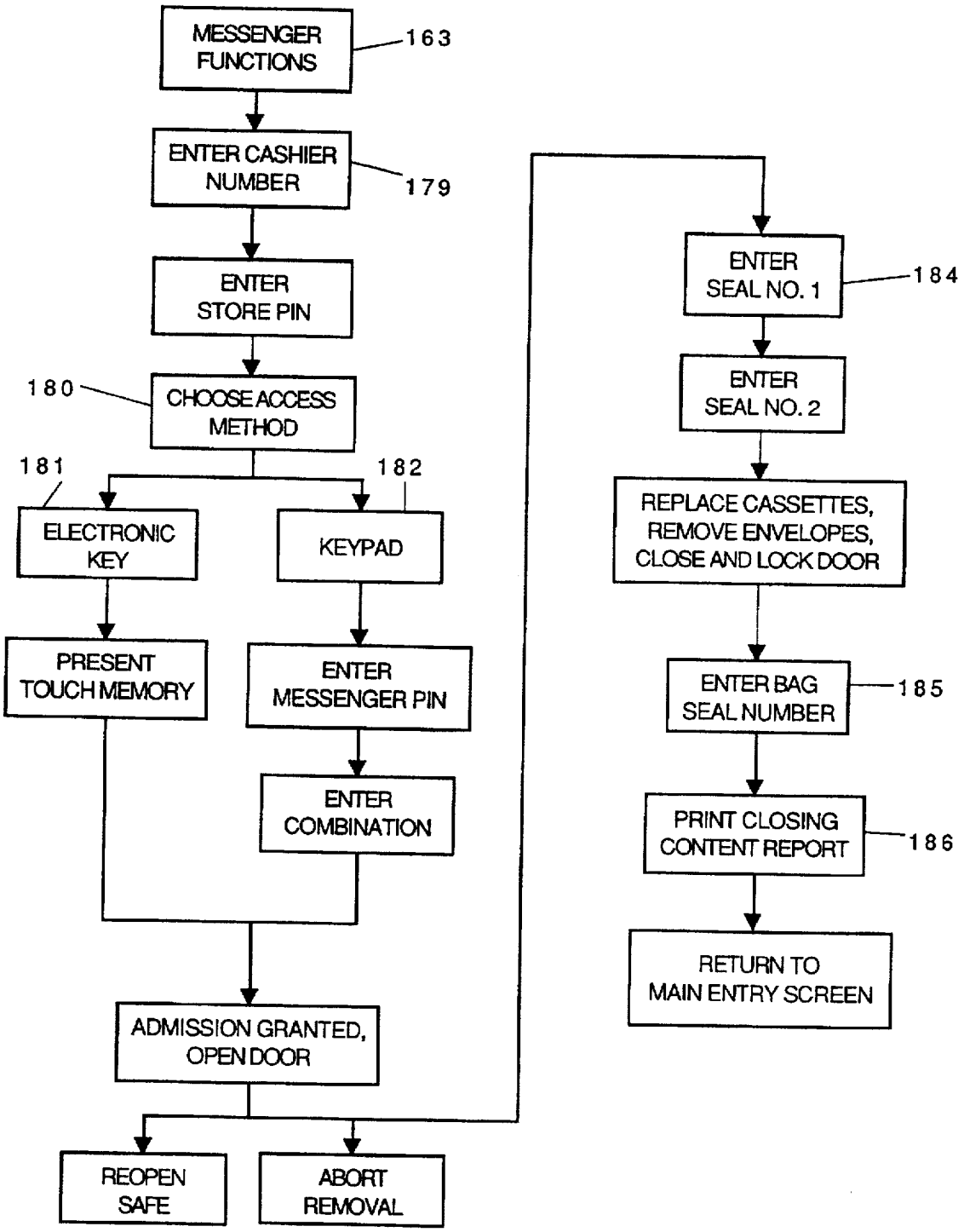
FIG. 10 is a block diagram illustrating the hierarchy of menus and related subfunctions for the messenger functions showing FIG. 8.

Removal of the safe contents is accomplished through the messenger function 163 shown in FIG. 8 and discussed in detail with reference to FIG. 10. An armored-car messenger will visit the store or other location to collect the safe contents, and that messenger will know both the numerical combination for the particular drop safe and also a messenger PIN unique to that person. Preferably, the messenger will carry an electronic key in the nature of a memory module chip as described above. As part of the content removal function, a closing content report is printed as described below, to document the present contents of the drop safe for the store supervisor and for the armored-car service.

Content removal is initiated by selecting the content-removal function 163 from the main menu selections on the terminal display 28. That function prompts the cashier to enter his or her cashier number as shown at 179 (FIG. 10), so that the name of the cashier present at the content removal will be printed on the closing content report. After an authorized cashier number is entered, the display prompts the cashier to enter the store PIN. After that number is entered and verified by the processor, the display then prompts to chose the particular access method for opening the safe, as indicated at 180. The two available access methods with the disclosed embodiment are by electronic key as indicated at 181, or by manually entering the access codes on the keypad 27, indicated by the step 182. If the messenger is carrying a memory module chip, the electronic-key function 181 is chosen and the messenger presents that memory module to the memory module port 189 located on the terminal 26. If the keypad function 182 is chosen, the display prompts entry of the messenger PIN for confirmation by the processor. Once the proper messenger PIN is entered, the display prompts the messenger to enter the numerical combination predetermined for that particular safe and stored in memory. If the processor verifies that the messenger entered the proper combination or if the correct memory module key was inserted, the dead bolt solenoid 131 is actuated to enable opening the lock mechanism as discussed above, and the acceptors are disabled from accepting bills until content removal is completed as described below. Unlocking is acknowledged by a display message stating that admission is granted and prompting the messenger to open the door to the drop safe. The messenger opens the door by turning the dial 107 and then swinging the door downwardly to its maximum extent as described above. If the processor does not receive a signal from the tilt switch 147 that the door has been opened within a predetermined time after admission is granted, the processor disables the dead bolt solenoid to relock the door. At that time, the display presents the messenger with the option of reopening the safe or aborting removal of its contents. Selecting the abort function terminates the content-removal procedure and returns the display to the main menu.

If the particular drop safe is equipped with a memory module port 189 as described above, the messenger's PINs for one or more drop safes on a route can be recorded on the memory module key carried by the messenger. Each memory module chip also stores a unique serial number identifying that particular chip. The messenger in that case need only place the memory module key in data communication with the port 189 to access the safe.

Armored-car messengers servicing drop safes usually arrive at each location carrying a pair of empty currency cassettes in a sealable bag. Each empty cassette is locked and sealed, and each seal bears a unique number affixed at a central location. When the messenger unlocks and opens the safe door, the display 28 prompts the messenger to enter the seal numbers of the new cassettes into the keypad 27, as shown at 184. Those cassette seal numbers are stored in memory and will be reported when the messenger removes the cassettes in a subsequent trip to that location; the seal numbers for the cassettes now in the safe were entered at the most recent prior servicing of the safe. After the second seal number is entered, the display prompts the cashier to remove the cassettes from the acceptors, to remove the drop envelopes or packets from the safe, and to close and lock the safe door. The messenger places the removed cassettes in the bag, and the cashier places the unsealed packets or envelopes into the same bag and affixes a numbered seal to the closed bag.

To further increase the efficient operation of drop safes according to the present invention, each cassette can have a permanent barcode label and be sealed with a seal having a unique seal number barcoded onto the seal. The barcodes for each empty cassette and its seal are read at the central location, and those barcodes are again read when the cassettes are returned to that location for counting the money. This arrangement verifies the identity of each cassette leaving and returning to the central counting location.

The tilt switch 147 again signals the processor when the safe door assembly 34 is returned to its upright position, signaling closure of the safe, and the dead bolt switch 134 likewise signals that the door to the drop safe is closed and locked. When the processor receives those signals, the display prompts the messenger to enter the number of the seal placed on the bag by the cashier or store supervisor, as shown at step 185. Once that number is entered into the keypad, the drop safe automatically prints a closing content report for that drop safe, as shown at 186. This closing content report may contain the summary information discussed above for the read-only content report, in addition to printing the seal numbers entered for the first and second cassettes and for the bag seal. The closing content report thus summarizes the contents of the drop safe by the first and second cassettes and by envelopes, and also provides a summary breakdown of that information by the date of each business day when the safe deposits occurred. The report also prints the name of the store person who initiated the content removal, and the serial number of the memory module key, if any, used to open the safe. The processor zeros out the content totals for that collection after preparing the closing content report. Once the content removal from the drop safe is completed, the processor returns the display to the main entry screen and enables the acceptors for receiving further deposits.

The printed closing content report preferably also includes deposit totals for each business day that closed since the last pickup from the drop safe. Those daily deposit totals will not be the same as the breakdowns by business day summarized elsewhere on the closing report, unless at least one complete business day elapsed since the safe contents were last picked up before the present content removal. However, the printed deposit-day totals should equal the sum of the segments of each business day summarized in all the content reports containing all portions of that business day, and the information thus is important for the armored-car service responsible for collecting deposits from the drop safe and giving proper credit of those deposits by business day and by store.

Figure 11:
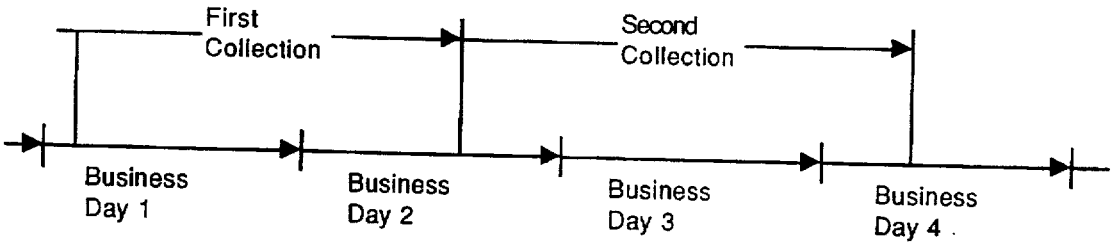
FIG. 11 is a timeline illustrating an example of business days and overlapping collection days for operating a drop safe according to the present invention.

FIG. 11 illustrates a typical example of drop-safe collections overlapping different days. That figure shows four consecutive business days and two collections spanning parts of those four days. The first collection occurs approximately midway during the second business day and covers a period that began soon after the first business day commenced. The second collection occurs during the fourth business day. That collection thus covers the remainder of the second business day and the entire third business day, as well as a beginning portion of the fourth business day.

The closing content reports for the first and second collections, considered together, contain information for the complete second and third business days. However, those two collection reports must be combined with preceding and subsequent collection reports to provide a complete picture of safe operations for the first and fourth business days.

The deposit-day summary for the closing collection report of the first collection day will indicate day totals only for the first business day, the last (and only) business day to close during the time of that first collection. When the closing collection report is printed for the second collection, that report will contain deposit day totals for the second and third business days, but not for the fourth business day (which ended after the second collection). Moreover, the deposit-day total for the third business day will show totals identical to the breakdown by date for that business day because the second collection period spanned the complete third business day.

It should now be understood that the information collecting and reporting capabilities of the present drop safe permit deposits by different cashiers, occurring during different shifts and over different business days, without the need of physically tagging those deposits for later identification while counting and reporting the contents of the safe. The contents of drop safes according to the present invention are removed with greater efficiency and security, because the bulk of the deposits to the drop safe usually are in cassettes that are locked and sealed, and readily removable by the messenger for transport to a money counting location. The drop safe itself provides information reports that can be verified at the counting center, and cross-checked against the day .totals to provide an accurate and complete picture of deposits made to each drop safe by business day. Moreover, most bills should be in the cassettes removed from the safe, and are prestacked for easier mechanized counting. The cash receipts thus are more readily credited to the store accounts, at a lesser cost for handling and counting those receipts.

The message function 164 (FIG. 8) under the main menu 160 allows the processor to present various preprogrammed messages to the user of the drop safe. This function will be familiar to one of ordinary skill in the art. Examples of such messages alert the user to an AC power Outage, or the printer 29 being offline. The system is programmed to announce the presence of such messages by emitting a beep through the audio signal 156, prompting the user to view the message by selecting the message function 164 on the main menu.

The operation of the drop safe as described thus far relies on the memory and judgment of cashiers or store managers in deciding when to transfer cash from a register or other point-of-sale (POS) terminal to the drop safe. For security purposes, cash exceeding some predetermined amount should be transferred from cash drawers to the drop safe, but a cashier who is busy with customers or otherwise preoccupied may not make timely transfers to the drop safe. This problem can be overcome with a modification of the drop safe, as shown in FIG. 7. Assuming the drop safe is used in conjunction with one or more POS terminals 191 capable of producing signals that indicate the total volume of sales transactions over a particular time, those signals are transferred from the POS terminal to the processor 154 of the drop safe by the data line 190. The processor of the modified drop safe also preferably provides data output signals to a modem 192 capable of selective connection to a conventional dial-up telephone line.

The processor 154 is programmed to calculate the difference, from a particular starting time such as the beginning of a shift, between the total sales transactions at the POS terminal 191 and the total amount deposited into the drop safe through the current time as indicated by data in the memory 155. If the calculated difference exceeds a certain amount previously determined as the maximum amount desired in the POS cash drawer, the processor 152 actuates the audible signal 156, alerting the cashier of the need to transfer funds from the POS terminal into the drop safe. As those funds are transferred to the drop safe as described above, the increase in the cumulative amount of funds transferred to the drop safe decreases the difference between the POS receipts and that cumulative amount, causing the processor 154 to turn off the signal 156 when that difference drops below a previously-determined amount. In this way, cashiers and other operators are reminded to transfer funds to the drop safe, preventing accumulations of currency at the POS terminal that could tempt robbers and increase losses to the store operator. In a preferred use of the drop safe, cashiers should transfer funds to the drop safe without waiting for a reminder signal.

If no transfer of cash to the drop safe occurs within a certain time after the processor 154 issues an alert as mentioned above, or if another operating parameter such as the ratio of manual/acceptor cash deposits, as may be caused by excessive manual drops, falls outside a predetermined threshold, the processor 154 is programmed to communicate that occurrence to an outside supervisor or area manager. This is accomplished in the disclosed embodiment by signaling the modem 192 to dial a predetermined telephone number and present a predetermined message when that number answers. Area managers frequently travel outside a fixed office and carry beepers to remain in touch. Accordingly, the processor 154 may be programmed to call the beeper number for an area manager, and to send a predetermined alphanumeric code indicating that particular event for the calling store. When the supervisor receives that message via beeper, the supervisor then can call the store manager or cashier to inquire why funds are not being transferred from the POS terminal to the drop safe or why another operating parameter is out of range. The supervisor also can verbally tell the store manager the particular code displayed on the beeper, and the store manager can enter that code on the keypad 27 of the drop safe. The processor 154 is programmed to deactivate the signal 156 in response to entry of that code.

The processor 154 can also be programmed to produce a local alert or to communicate by modem to an armored-car messenger service, in response to the transfer of currency exceeding a predetermined amount into the acceptor cassettes. The amount of currency so transferred is accumulated by the processor and compared with the predetermined amount, so that an alert signal can summon the messenger to replace the cassettes before the cassettes of all acceptors become filled to capacity.

Drop safes according to the present invention are adaptable to the locations having more than one POS terminal or cash register. For example, a main drop safe including a processor 154 and acceptor, such as described herein, can be operationally combined with one or more remote drop safes 157 (FIG. 7) having, at a minimum, one currency acceptor. Those remote drop safes, however, lack processors of their own and instead are connected to and controlled by the processor in the main drop safe. The remote drop safes in effect are slave units placed near the separate POS terminals for convenient transfer of currency from those terminals, but operating under control of the processor in the main drop safe. That processor thus provides data collection and reporting functions for the main drop safe and for the auxiliary drop safes connected thereto.

A drop safe according to the present invention can be modified to operate in conjunction with a change dispenser. For example, such a dispenser can be preloaded with rolls of coins in various denominations and connected with the processor of the drop safe. When the store clerk transfers a $10 bill (for example) into the drop safe and enters the proper instruction into the terminal, the processor signals the change dispenser to dispense one or more rolls of coins which the clerk can use in making change. The various reports of drop-safe operation would include the particulars of coins thus dispensed to the cashiers.

It should be understood that the foregoing relates only to preferred embodiments of the present invention, and that numerous changes and modifications therein may be made without departing the spirit and scope of the invention as defined in the following claims.

What is claimed is:

1. A drop safe for receiving funds deposited into the safe at various times throughout collection periods that may include parts of at least one predefined business day not coincident with any collection period, comprising:

a housing defining an interior region;

apparatus associated with the housing and operative to receive funds tendered outside the housing and transfer the tendered funds into the interior region;

means associated with the safe for storing signals identifying the date and the amount of each deposit into the safe;

means operative to access the interior region for removing the funds deposited into the safe; and means responsive to the identifying signals and operative upon removal of the deposits at the end of a collection period to sum, for each partial business day and complete business day during the collection period, the amounts deposited into the safe for each such business day during the collection period and produce a closing content report of said sums, so that the aggregate of the partial and complete business day sums equals the total amount deposited in the safe during the collection period, whereby the total amount deposited for a business day covering portions of plural collection periods is determinable from the sums for the portions of that business day on the closing content reports for the plural collection periods.

2. The drop safe as in claim 1, further comprising:

means responsive to the stored signals and operative upon removal of the deposits to sum the amounts identified as deposited for any partial business day ending during the collection period with amounts identified for the same business day during previous collection periods, so that the summed amounts for the partial business days identify the total amounts deposited into the safe for each complete business day.

3. The drop safe as in claim 1, wherein the means to identify the total amounts comprises a programmed processor.

4. The drop safe as in claim 3, wherein:

the housing is a first such housing defining a first interior region for receiving tendered funds; and further comprising a second housing remotely located from the first housing and defining a second interior region for receiving funds tendered from outside the second housing;

means associated with the second housing for producing signals identifying each deposit of funds into the second housing;

means communicating said identifying signals to the processor associated with the first house and the means responsive to the identifying signals is operative at the end of a collection period to produce said sums by business day irrespective of the housing that received the deposits.

5. The drop safe as in claim 3, wherein the apparatus for receiving funds comprises a bill acceptor responsive to the denominations of bills tendered to the acceptor and operative to produce signals corresponding to the denomination of each bill thereby accepted.

6. The drop safe as in claim 5, wherein the safe further comprises:

a manual deposit drop associated with the housing for depositing funds into the safe independently of the acceptor;

means for manual entry of information relating to a manual deposit and operative to produce signals corresponding to said information; and the means for storing signals is operative to store the manual deposit signals, whereby the amounts identified for each business day and partial business day include the amounts manually entered.

7. The drop safe as in claim 1, wherein:

the means operative upon removal of the deposits is also operative to identify the total amounts deposited for each business day that closed during the collection period, whereby those total day amounts equal the sum of the amounts deposited for each said closed business day from the current and previous collection periods.

* * * * *